US006239339B1

(12) United States Patent
Sembach

(10) Patent No.: US 6,239,339 B1
(45) Date of Patent: May 29, 2001

(54) RESONANCE BODY FOR A STRING INSTRUMENT

(76) Inventor: Joerg Sembach, Bueltenweg 64, D-38106, Braunschweig (DE)

( * ) Notice: Subject to any disclaimer, the term of this patent is extended or adjusted under 35 U.S.C. 154(b) by 0 days.

(21) Appl. No.: 09/462,156

(22) PCT Filed: May 3, 1999

(86) PCT No.: PCT/DE99/01291

§ 371 Date: Jan. 5, 2000

§ 102(e) Date: Jan. 5, 2000

(87) PCT Pub. No.: WO99/57708

PCT Pub. Date: Nov. 11, 1999

(30) Foreign Application Priority Data

May 5, 1998 (DE) ..... 198 19 851

(51) Int. Cl.[7] ..... G10D 13/08

(52) U.S. Cl. ..... 84/410; 84/189; 84/190; 84/192

(58) Field of Search ..... 84/410, 189, 190, 84/192

(56) References Cited

U.S. PATENT DOCUMENTS

| | | | |
|---|---|---|---|
| 962,393 | 6/1910 | Sheldon | 84/192 |
| 1,985,746 | 12/1934 | Settergren | 84/186 |
| 4,602,548 | 7/1986 | Conklin, Jr. | 84/209 |
| 6,072,111 * | 6/2000 | Senn | 84/402 |

FOREIGN PATENT DOCUMENTS

| | | |
|---|---|---|
| 81 771 | 5/1971 | (DD) . |
| 66040 | 2/1892 | (DE) . |
| 375023 | 5/1923 | (DE) . |
| 389846 | 2/1924 | (DE) . |
| 428162 | 4/1926 | (DE) . |
| 747613 | 10/1944 | (DE) . |
| 1 059 749 | 6/1959 | (DE) . |

* cited by examiner

*Primary Examiner*—Shih-Yung Hsieh

(57) ABSTRACT

The invention relates to a sound body for a stringed instrument, having an upper backframe (6) designed as a frame, to which a soundboard (4) is adhesively bonded, and on which there are provided at least one bridge (8) extending approximately diagonally and a cast frame provided with a set of strings, and having a lower backframe which is arranged under the upper backframe (6) and is connected thereto. In order largely to maintain the once predefined tuning, even during fluctuations in the climatic conditions in a room, the invention proposes that the upper backframe (6) be connected to the lower backframe (16) only in its diagonally opposite connection regions **(18*a*, 18*b*) facing the ends of said bridge (8), but have a clear spacing from the lower backframe (16) in the remaining edge regions (12*a*, 12*b*)**.

19 Claims, 2 Drawing Sheets

RESONANCE BODY FOR A STRING INSTRUMENT

BACKGROUND OF THE INVENTION

The invention relates to a sound body for a stringed instrument, having an upper backframe designed as a frame, to which a soundboard is adhesively bonded, on which there are provided at least one bridge extending approximately diagonally and a cast frame with a set of strings, and having a lower backframe which is arranged under the upper backframe and is connected thereto.

Sound bodies of the type described above are an essential element of upright pianos, grand pianos and other stringed instruments. The tuning of the instrument is predefined by the sound body. It is desirable for an instrument or sound body which has been tuned once to keep the tuning constant. The tuning of the sound body remains constant when the exact position of the elements of the sound body and, above all, the tension of the strings remain unchanged. The wooden components of the sound body, in particular of the soundboard, are, however, subject to dimensional fluctuations in the event of fluctuations in the climatic conditions in the room, through which the tuning of the sound body and of the instrument is then changed. Even small changes in the relative atmospheric humidity at the transition from the heating period to the summertime conditions in the room or from the transition between an air-conditioned practice room and a concert hall which is hardly heated at all have the effect of swelling or shrinkage of the wood and therefore a change to the set tuning.

The sound body described at the beginning can be taken from German Patent 375 023. Here, the upper backframe is formed by a frame made of grooved strips, which are led around the entire circumference of the soundboard, improve the effect of the sound and at the same time are intended to ensure protection against stressing. In this case, the narrow upper edge of the grooved strips forms the supporting surface for the soundboard to be glued on. The lower backframe consists of a hollow frame, which has a somewhat larger external contour than the upper backframe and is stiffened by two transverse spars spaced apart from each other.

In the event of fluctuations in the climatic conditions, it is primarily the dimensions of the soundboard which change, but also the dimensions of the upper backframe. Neither the soundboard nor the supporting element of the sound body, the upper backframe, therefore satisfy the preconditions of dimensional stability under climatic fluctuations. In attempts to improve the dimensional stability of sound bodies, it has been shown that an attempt to hamper or prevent the dimensional changes to the soundboard often leads to damage, especially to plastic deformations or cracks in the soundboard.

SUMMARY OF THE INVENTION

The object of the invention is to provide a sound body which ensures that the tuning, once predefined, only changes to a slight extent in the event of fluctuations in the climatic conditions in the room.

Starting from the sound body described at the beginning the present object is achieved, according to the invention, in that the upper backframe is connected to the lower backframe only in its diagonally opposite connection regions facing the ends of said bridge, but has a clear spacing from the lower backframe in the remaining edge regions.

It is expedient if the thickness of the upper backframe decreases from a maximum value in the connection regions toward the remaining edge regions. The upper backframe therefore "floats" over the lower backframe in the remaining edge regions. This connection of the two backframes only in some sections largely prevents fluctuations in the tuning of the sound body or of the instrument caused by climatic fluctuations. In order to implement the connection of the upper backframe to the lower backframe in some sections, the thickness of the upper backframe, which is normally about 6 to 8 cm, can be reduced in those regions where the two backframes are not connected to each other. This reduction in the cross section is readily possible, since the upper backframe no longer has to contribute to the overall stability of the sound body.

Surprisingly, it has been established that the dimensional changes occurring as a result of the swelling and shrinkage of the soundboard can be tolerated to a considerable extent provided the two backframes are fixed in a defined position in relation to each other only in said connection regions, in which the bridge or its imaginary extension ends.

According to the invention, this fixed alignment to one another is primarily ensured by a torsionally rigid and dimensionally stable lower backframe, which represents a dimensionally stable reference element of the sound body and therefore preferably consists of metal. The upper backframe, on the other hand, can still preferably be produced from wood, since the necessary stability of the sound body is largely ensured by the lower backframe.

The upper and lower backframes can intrinsically be connected to each other in any desired way, but adhesively bonding the two backframes as a flat, thrust-resistant connection has proven to be particularly advantageous by comparison with point-by-point connections, for example by comparison with screwing. Furthermore, adhesive bonding offers the advantage that damage to the soundboard by drilled holes is avoided.

The soundboard preferably comprises strips which are glued to one another and whose fiber longitudinal direction is located approximately parallel to said bridge. In this case, the strips are preferably formed by wooden slats with a width of about 8 to 12 cm.

The aforementioned at least one bridge is an elongate main bridge, normally curved approximately in an S shape, which, in the case of previously known embodiments, generally extends diagonally over part of the soundboard and is adhesively bonded thereto. According to the invention, provision can additionally be made for said bridge to be fixed to the soundboard by means of a bridge tongue in each of the two said connection regions, the bridge tongues preferably being chamfered end sections formed in one piece with said bridge. The tone of the sound body is not impaired by the extension of the bridge as far as the connection region [lacuna] the aforementioned edge region of the soundboard.

The lower backframe is preferably formed by a frame whose external dimensions correspond approximately to those of the upper backframe. In order to be able to absorb high forces with the minimum use of material, the lower backframe preferably has at least one first strut, which is located approximately parallel to the strings fastened to the cast frame. Since the dimensional changes of the soundboard are usually the greatest in this direction, the effect of this first strut, which is able to absorb considerable tensile forces, is a particularly effective saving on material. A number of first struts arranged alongside one another increase this effect. If these first struts are inserted into the frame of the lower backframe and are designed such that their length can be varied with respect to this frame, the setting of a prestress of the lower backframe, which can be transmitted to the upper backframe and to the soundboard, is possible.

A comparable effect is achieved when the lower backframe has at least one second strut, which is located approximately parallel to said bridge. Here too, the effect is increased by the arrangement of a number of parallel second struts. If this second strut is inserted into the frame of the lower backframe and is designed such that its length can be varied with respect to this frame, a prestress can thereby be imparted to the aforementioned bridge. This means that the tone of the sound body can be varied or set in a simple way. For the purpose of setting the length, the struts, which are led through drilled holes in the frame or eyelets on the frame, are provided with threaded sections. By means of lock nuts, the desired length on the lower backframe can then be set continuously.

It is advantageous if the lower backframe has a flat, preferably ground upper side. This upper side is suitable as a constructional reference plane of the sound body. This results in the further advantage that sound bodies can be produced with dimensions which are always the same.

For high production accuracy and for the production of a sound body with a stable tuning which is largely independent of climatic fluctuations, it is particularly advantageous if the cast frame is connected to the lower backframe through the soundboard and the upper backframe. This connection can be produced in any desired way, be it by screws, bolts or rivets, by clamping or else by adhesive bonding. At least the drilled holes in the cast frame and in the lower backframe are preferably produced on CNC-controlled production installations and are therefore particularly precisely positioned. Surprisingly, it has been shown that the tone of the sound body is not affected detrimentally by the connection of the aforementioned parts to one another, provided this connection is in each case provided only in the two aforementioned connection regions. However, no impairment to the tone occurs either if the aforementioned connection is in each case also led through the bridge tongue of said bridge. The bridge tongues serve to fix the bridge to the soundboard and are designed as separate fastening elements or else which is preferred—as single-piece extensions of the bridge, and are chamfered at their ends, in order to minimize changes to the tone of the sound body. In this case, according to the invention each bridge tongue is provided with a defined drilled hole, that is to say one whose position is defined precisely, which is in alignment with the defined drilled holes in cast frame, soundboard, upper backframe and lower backframe during the production of the sound body, before the fastening means are inserted, which ensures the always constant alignment of the bridge on the soundboard and the likewise identical alignment of the soundboard on the upper and lower backframes, as well as the same arrangement of the cast frame on the soundboard.

In order to set the oscillatory behavior, it is expedient if one or more weights can be fixed to the cast frame and/or to the soundboard and/or to the upper backframe and/or to the lower backframe. Influencing the tone in this way, or compensation, produced in this way, of fluctuations in the tuning of a soundboard or of an instrument is advantageous, in particular in the construction according to the invention, since the possibility of exerting and influence on the tone is particularly great, as a result of the free construction of the upper backframe.

BRIEF DESCRIPTION OF THE DRAWINGS

Some embodiments of the invention, serving as examples, are illustrated in the drawing, in which.

DETAILED DESCRIPTION OF PREFERRED EMBODIMENTS

Figure 1:
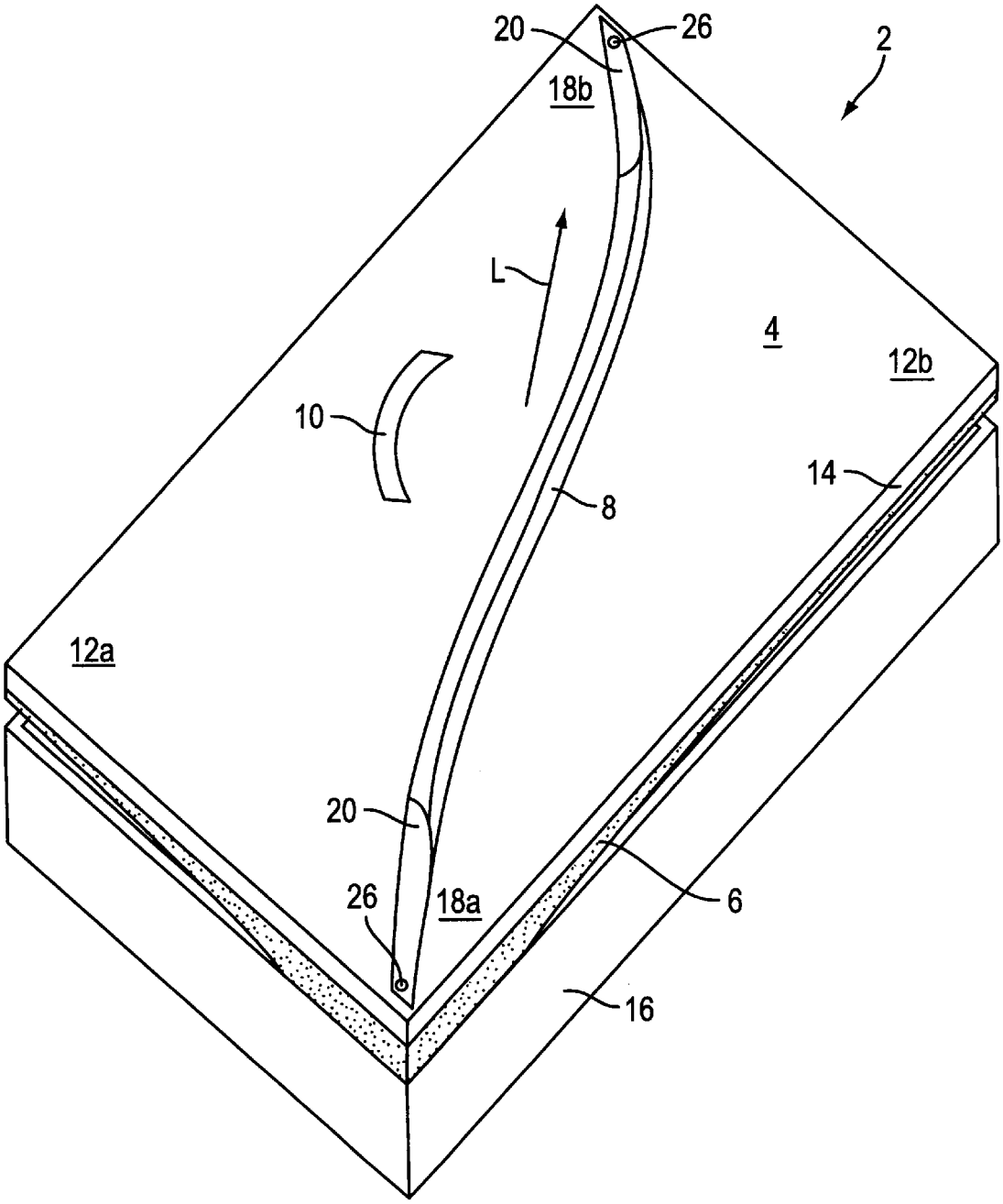
FIG. 1 shows a sound body, illustrated schematically in plan view and perspective illustration.

FIG. 1 shows the schematic view of a sound body 2, in which a soundboard 4 is adhesively bonded onto an upper backframe 6. An elongate main bridge 8, curved approximately in an S shape and a shorter base bridge 10 are adhesively bonded to the soundboard 4.

The soundboard 4 comprises strips 14 with a width of about 8 to 12 cm which are glued to one another. The fiber longitudinal direction of the strips is indicated by an arrow L. The maximum swelling or shrinkage dimension of the strips, and therefore the maximum dimensional change of the soundboard 4, is exhibited approximately at right angles to the arrow L. The greatest effects of the dimensional change as a result of climatic fluctuations are to be expected in the edge regions 12*a, b* of the soundboard.

In the embodiment of the sound body 2 according to FIG. 1, the main bridge 8 is arranged in the region of minimum dimensional change.

The upper backframe 6 is adhesively bonded to a lower backframe 16. The backframes 6, 16 are adhesively bonded to each other in the connection region 18*a, b* of the main bridge 8. The connection region 18*a, b* is the edge region of the soundboard 4 where the main bridge 8 is fixed with respect to the soundboard 4 by means of bridge tongues 20, where the soundboard 4, the upper backframe 6 and the lower backframe 16 overlap one another. The bridge tabs 20 can be designed as separate fastening elements, but preference is given, as shown in FIG. 1, to the bridge 8 being lengthened overall and being designed with chamfered end sections, the bridge tongues 20.

Connecting the upper backframe 6 to the lower backframe 16 in sections is possible since the upper backframe 6 is designed to have its complete thickness only in the connection regions 18*a, b*. The thickness of the upper backframe 6 decreases from the connection regions 18*a, b* toward the edge regions 12*a, b*. In the edge regions 12*a, b*, the upper backframe 6 "floats" above the lower backframe 16.

The external dimensions of the lower backframe 16 correspond to the upper backframe. Said lower backframe mostly comprises a rectangular hollow profile, but solid profiles can also readily be used. Instead of pure metal profiles, composite materials made of metal and plastic can also be used, assuming that these materials ensure adequately high dimensional stability.

Figure 2:
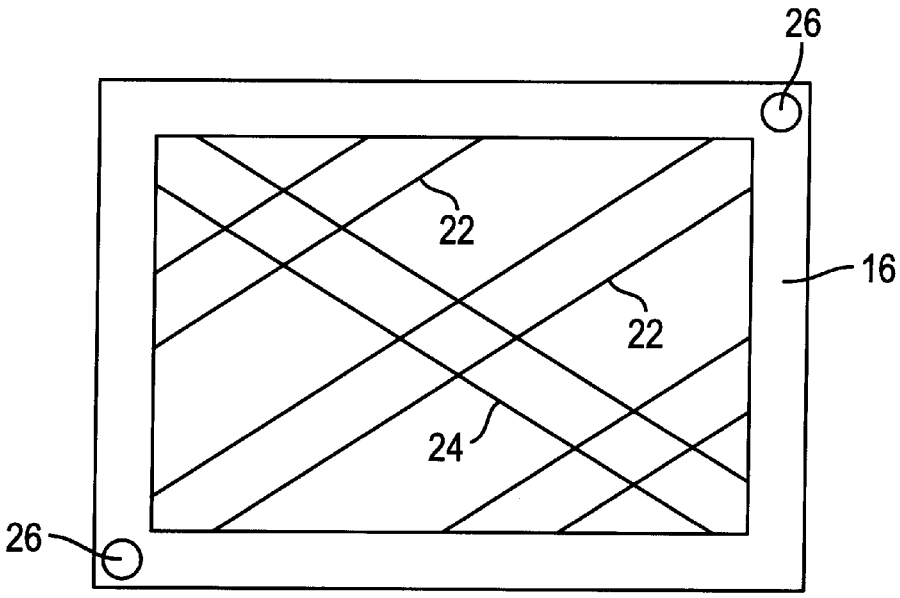
FIG. 2 shows a plan view of a lower backframe, illustrated schematically.

FIG. 2 shows a lower backframe 16, illustrated schematically. Inserted into the lower backframe 16 are first struts 24, which are aligned approximately parallel to the strings fastened to the cast frame. These first struts 24 are intended to absorb the tensile stresses which are transmitted by the strings to the lower backframe 16.

In addition, second struts 22 are inserted into the lower backframe 16, these running approximately parallel to the main bridge 8 adhesively bonded to the soundboard 4. By means of these second struts 22, the intention is to impress a certain prestress onto the bridge. In the embodiment depicted, the struts 22, 24 are welded to the lower backframe 16. However, it is also possible to lead the struts 22, 24 through drilled holes in the lower backframe 16 and to make them adjustable by means of threaded sections and lock nuts.

Drilled holes 26 are made in diagonally opposite corners of the lower backframe 16. These drilled holes 26 are always implemented as positionally accurate precision drilled holes, for example using CNC-controlled drilling machines. These drilled holes are used for the precise alignment and fixing of the upper backframe 6, the soundboard 4, the bridge 8 and the cast frame.

Figure 3:
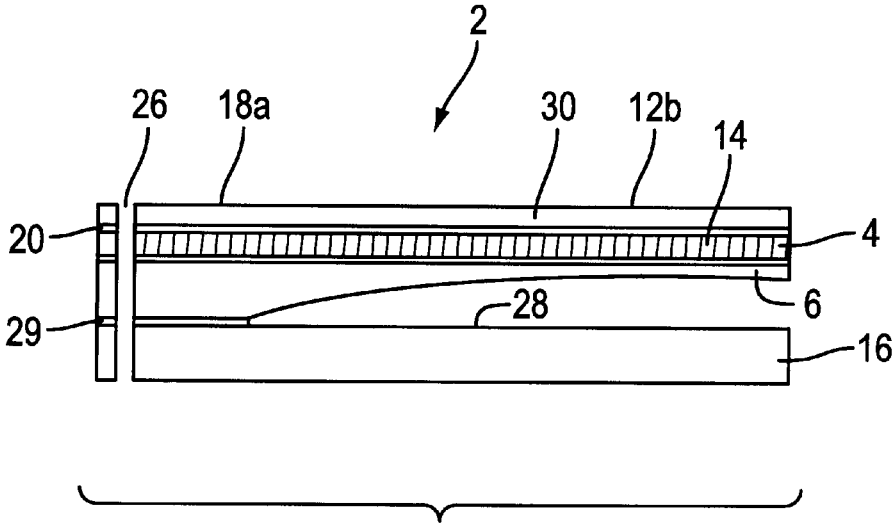
FIG. 3 shows a cross section through a sound body, illustrated schematically.

FIG. 3 shows a section through a sound body 2. An upper backframe 6 is arranged on a lower backframe 16. The upper side 28 of the lower backframe 16 is ground and therefore ensures a completely flat supporting surface.

The upper backframe 6 is adhesively bonded to the upper side 28 of the lower backframe in the region 18*a* of the attachment of the bridge tongue 20, for example using an epoxy resin. The adhesively bonded joint 29 between the upper backframe 6 and the lower backframe 16 is indicated. The cross section of the upper backframe 6 tapers from the attachment region 18*a* as far as the edge region 12*a* of the soundboard 4. Located above the soundboard 4 is a cast frame 30.

In the connection region 18*a* of the bridge tab 20, a drilled hole 26 passes through the lower backframe 16, the upper backframe 6, the soundboard 4 adhesively bonded to the upper backframe 6, and the cast frame 30 resting on the soundboard to which cast frame the strings (not illustrated here) are fixed. The drilled hole 26 is—as described above—a precision drilled hole. If the fastening means (not illustrated here), for example a screw, a bolt, or a clamp, is inserted into the drilled hole, the essential components of the sound body 2 are fixed in a precisely defined position in relation to one another.

What is claimed is:

1. Sound body for a stringed instrument, having an upper backframe (6) designed as a frame, to which a soundboard (4) is adhesively bonded, on which there are provided at least one bridge (8) extending approximately diagonally and a cast frame (30) adapted for attachment of a set of strings, and having a lower backframe (16) which is arranged under the upper backframe (6) and is connected thereto, characterized in that the upper backframe (6) is connected to the lower backframe (16) only in its diagonally opposite connection regions (18*a*, 18*b*) facing the ends of said bridge (8), but has a clear spacing from the lower backframe (16) in the remaining edge regions (12*a*, 12*b*).

2. Sound body according to claim 1, characterized in that the thickness of the upper backframe (6) decreases from a maximum value in the connection regions (18*a*, 18*b*) toward the remaining edge regions (12*a*, 12*b*).

3. Sound body according to claim 1, characterized in that the upper backframe (6) is adhesively bonded to the lower backframe (16).

4. Sound body according to claim 1, characterized in that the soundboard (4) comprises strips (14) which are glued to one another and whose fiber longitudinal direction (L) is located approximately parallel to said bridge (8).

5. Sound body according to claim 1, characterized in that said bridge (8) is fixed to the soundboard (4) by means of a bridge tongue (20) in each of the two said connection regions (18*a*, 18*b*).

6. Sound body according to claim 5, characterized in that the bridge tongues (20) are chamfered end sections formed in one piece with said bridge (8).

7. Sound body according to claim 5, wherein the cast frame is connected to the lower backframe through the soundboard, the upper backframe and the bridge tongue (20) of said bridge (8).

8. Sound body according to claim 1, characterized in that the lower backframe (16) is formed by a frame whose external dimensions correspond approximately to those of the upper backframe (6).

9. Sound body according to claim 1, characterized in that the lower backframe (16) has at least one first strut (24), which is located approximately parallel to strings when fastened to the cast frame (30).

10. Sound body according to claim 9, characterized in that the lower backframe (16) has at least one second strut (22), which is located approximately parallel to said bridge (8).

11. Sound body according to claim 9, characterized in that said first strut (24) and/or said second strut (22) are inserted into the frame of the lower backframe (16) and are designed such that their length can be varied with respect to this frame.

12. Sound body according to claim 1, characterized in that the lower backframe (16) has a flat, preferably ground, upper side.

13. Sound body according to claim 1, characterized in that the lower backframe (16) comprises of metal.

14. Sound body according to claim 1, wherein the cast frame (30) is connected to the lower backframe (16) through the soundboard (4) and the upper backframe (6).

15. Sound body according to claim 14, characterized in that said connection is in each case provided only in the two said connection regions (18*a*, 18*b*).

16. Sound body according to claim 13, wherein, for said connection, a defined drilled hole (26) is provided in said cast frame, said lower backframe, said soundboard and said upper backframe.

17. In a stringed instrument having a sound body, the improvement comprising the sound body comprising an upper backframe designed as a frame, to which a soundboard is adhesively bonded, on which there are provided at least one bridge extending approximately diagonally and a cast frame adapted for attachment of strings, and having a lower backframe which is arranged under the upper backframe and is connected thereto, wherein the upper backframe is connected to the lower backframe only in its diagonally opposite connection regions (18*a*, 18*b*) facing the ends of said bridge, but has a clear spacing from the lower backframe in the remaining edge regions (12*a*, 12*b*).

18. A stringed instrument according to claim 17, wherein the stringed instrument comprises an upright piano.

19. A stringed instrument according to claim 17, wherein the stringed instrument comprises a grand piano.

* * * * *

UNITED STATES PATENT AND TRADEMARK OFFICE

CERTIFICATE OF CORRECTION

PATENT NO. : 6,239,339 B1
DATED : May 29, 2001
INVENTOR(S) : Joerg Sembach

It is certified that error appears in the above-identified patent and that said Letters Patent is hereby corrected as shown below:

Title page,
Please insert
-- [73] Fraunhofer Gesellschaft zur Foerderung der Angewandten Forschung E.V., Muenchen (DE) --.

Signed and Sealed this

Seventeenth Day of September, 2002

*Attest:*

*Attesting Officer*

JAMES E. ROGAN
*Director of the United States Patent and Trademark Office*